US005906527A

United States Patent [19]

Shaikh et al.

[11] Patent Number: 5,906,527

[45] Date of Patent: May 25, 1999

[54] METHOD OF MAKING PLASMA DISPLAY PANELS

[75] Inventors: Aziz S. Shaikh, Ventura; Kevin W. Allison, Goleta; Todd K. Williams, Santa Barbara, all of Calif.

[73] Assignee: Ferro Corporation, Cleveland, Ohio

[21] Appl. No.: 08/739,762

[22] Filed: Oct. 30, 1996

[51] Int. Cl.[6] ..... H01J 9/24

[52] U.S. Cl. ..... 445/24; 430/198

[58] Field of Search ..... 445/24; 430/198

[56] References Cited

U.S. PATENT DOCUMENTS

| | | | |
|---|---|---|---|
| 5,011,391 | 4/1991 | Kawasaki et al. | 445/24 |
| 5,209,688 | 5/1993 | Nishigaki et al. | 445/24 |
| 5,232,549 | 8/1993 | Cathey et al. | 445/24 X |
| 5,258,335 | 11/1993 | Muralidhar et al. | 501/20 |

FOREIGN PATENT DOCUMENTS

| | | | |
|---|---|---|---|
| 301934 | 12/1990 | Japan | 445/24 |

OTHER PUBLICATIONS

Kanagu et al., "A 31–in.–Diagonal Full–Color Surface–Discharge ac Plasma Display Panel," SID 92 Digest, pp. 713–719 (p. 717 is missing).

Normile, "Flat TV," Popular Science, Jan. 1992, pp. 87–93.

Takano et al, "A 25–in High–Contrast Color DC–PDP," SID 92 Digest, pp. 720–723.

*Primary Examiner*—Kenneth J. Ramsey

*Attorney, Agent, or Firm*—Rankin, Hill, Porter & Clark LLP

[57] ABSTRACT

The present invention provides a unique method of making a barrier rib structure for a plasma display panel. Instead of employing the traditional screen printing method of making barrier ribs, the present invention employs a section of low temperature cofired ceramic dielectric. The unique method includes the steps of providing a fusible dielectric composition in an organic binder, applying the composition on a glass sheet, applying a photoresist composition, placing a mask over the coated plate to provide a pattern of openings in the photoresist corresponding to the pattern of the picture subcells, using a laser to remove the portions of the coating not covered by the photoresist to form the color subcells and heating the resulting assembly to a sintering temperature to fuse the dielectric composition to form the barrier rib structure and to fuse the barrier rib structure to the glass plate.

7 Claims, 5 Drawing Sheets

METHOD OF MAKING PLASMA DISPLAY PANELS

FIELD OF THE INVENTION

This invention relates to flat panel displays and especially to flat display screens of the type that utilize a gas-plasma system wherein an electrical voltage pulse is used to excite a volume of gas plasma confined in a color cell of a picture element (pixel). The excitation of the plasma serves to activate a color phosphor located in the cell. These screens are generally known as plasma display panels (PDP's). More particularly, the invention relates to a process for constructing the cell walls that define the individual pixels that contain a volume of the gas plasma as well as the respective color phosphors.

BACKGROUND OF THE INVENTION

Among the large, flat, full color, high-definition television screens or panels currently available, the gas-plasma-type panel has achieved considerable success. These display panels may be hung on a wall, much like a framed picture or the like, and provide excellent display quality, as well as a wide viewing angle. Screens as large as 55" diagonal size have been produced with a thickness of around ¼ in. While these panels are quite light and thin, they can produce sharp pictures in rooms with only ordinary illumination.

The construction of these plasma display panels is rather complex, particularly in view of the large number of pixels that must be used to achieve the high-definition desired. The panels utilize a pair of parallel dielectric glass plates including a front plate and a rear plate. The plates are separated by a barrier rib structure that serves to define with the two glass plates, a plurality of pixels each of which generally includes 4 individual color subcells arranged in a square pattern. In a typical design, the 4 subcells include a blue subcell, a red subcell and 2 green subcells. Each subcell contains a color phosphor that is activated by an excited volume of gas plasma contained in the subcell. The gas plasma is excited by means of a voltage pulse generated by a control circuit.

The control circuit includes a plurality of electrodes including parallel conductive anode strips that are printed or formed by a thick film technique on the interior surface of the rear glass plate. Correspondingly, a plurality of parallel conductive cathode strips are printed or formed by a thick film technique on the interior surface of the front plate and oriented perpendicular to the anode strips on the rear plate.

A white backing layer is formed on the interior surface of the rear plate to provide a white backing for the phosphors. The individual phosphors for each cell are printed or formed by various other techniques on the white backing layer in a pattern that corresponds to the pattern of the color subcells.

The front plate also has a plurality of color filters in the form of film segments applied to the outer surface of the panel in a pattern corresponding to the arrangement of the color subcells. For example, a red filter segment is positioned over a subcell with a red phosphor, a blue filter segment is positioned over a subcell with a blue phosphor and a green filter segment is positioned over a subcell having a green phosphor. The remaining portions of the outer surface of the front plate have a black film layer applied thereto to form a black matrix that surrounds and encloses the filter segments.

The conventional technique for forming the barrier rib structure so as to partition the color subcells, has been to perform a number of screen prints having the desired barrier rib pattern thereon defined by a layer of fusible dielectric material such as a dielectric thick film material. The thickness of these individual prints may be for example, about 0.02 mm. The height of the color subcells may be for example, between 0.1 mm and 0.2 mm so that 5 or 10 or more individual screen prints would be required to produce the desired barrier rib height.

These multiple screen prints are placed or printed on the interior surface of one of the glass plates (preferably the rear plate) and aligned with one another as well as with the respective front glass plate. The assembly is then fired to fuse the screen patterns to one another and to the interior surfaces of the glass plates.

The accurate alignment of the successive prints and the line definition required over the relatively large area of the surface of the glass plates, are critical to the proper functioning of the plasma display panel. Because the alignment of each print is so critical, the process is quite cumbersome and also vulnerable to error.

The process of the present invention, however, reduces the difficulties indicated above and affords other features and advantages heretofore not obtainable.

SUMMARY OF THE INVENTION

The present invention provides an improved method for making a barrier rib structure for a plasma display panel of the type described. The method of the present invention provides various distinct advantages. Specifically, it allows one to control the dimensions of the pixels to a greater degree. Also, it avoids the time consuming process of building up the barrier ribs via multiple screen printings of dielectric material.

The display panel, as indicated above, includes a pair of spaced parallel flat glass plates and an arrangement of pixels defined by the two plates and the wall surfaces of the barrier rib structure separating them. Each pixel includes a number (conventionally four) of individual color subcells and a color phosphor for each subcell. Each subcell contains a gas plasma such as helium or xenon that may be excited by means of a voltage pulse controlled by a video control circuit.

The excitation of the plasma activates the respective phosphor in the color subcell. The excitation of the plasma in the subcells of a particular picture element or pixel is effected by voltage pulses to the respective subcells and the activation of the respective phosphors determines the visual effect or color effect produced by the pixel.

In accordance with one form of the method of the invention, the barrier rib structure is produced by the steps of:

1. Preparing a liquid composition comprising fusible dielectric particles in a binder;
2. Applying the liquid composition onto a substrate such as a glass plate to form a continuous first layer;
3. Drying and solidifying the resulting layer;
4. Applying a liquid photoresist composition over the dried first layer to form a continuous second layer;
5. Drying and solidifying the resulting second layer;
6. Placing a mask over the dried second layer to provide a pattern corresponding to the pattern of the barrier ribs;
7. Exposing the masked second layer to radiation from a light source;
8. Removing the mask;

9. Treating the second layer with a developer to remove portions thereof and to provide a pattern of exposed surface portions of said first layer corresponding to the pattern of the subcells;
10. Removing the portions of the first layer not covered by the remaining portions of the second layer to form the subcells;
11. Removing the remaining portions of the second layer; and
12. Heating the resulting product to sintering temperature to fuse the composition, burn off the organic binder and fuse the resulting barrier rib structure to the substrate.

In accordance with another form of the method of the invention, the barrier rib structure is produced by the steps of:

1. Preparing a liquid composition comprising fusible dielectric particles and a photoresist composition;
2. Applying the liquid composition onto a substrate such as a glass plate to form a photosensitive layer;
3. Drying the resulting layer;
4. Placing a mask over the dried layer to provide a pattern corresponding to the pattern of subcells;
5. Exposing the masked photosensitive layer to radiation from a light source;
6. Removing the mask;
7. Treating the layer with a developer to remove the portions thereof to form the subcells; and
8. Heating the resulting product to sintering temperature to fuse the dried layer, burn off at least a portion of the organic binder and fuse the resulting barrier rib structure to the substrate.

The barrier rib structure resulting from both forms of the method may be fused to the interior surface of either the front glass plate or the rear glass plate as desired for the particular plasma display panel. The assembled plates and other components may also be heated or fired to sintering temperature a second time so that the barrier rib structure is fused to the interior surface of both glass plates.

The liquid composition containing the dielectric particles and binder may, in both instances, include a variety of glass-ceramic dielectric materials. The product is usually the result of the grinding of the respective components to a fine powder and then mixing the respective powders with an organic binder to form the slurry.

Preferably, the resulting fused product will have a low dielectric constant, a high thermal conductivity, a low coefficient of thermal expansion and a relatively low sintering temperature (i.e. around 450°–600° C.). It is particularly important that the coefficient of thermal expansion of the barrier rib material be about the same as the coefficient of thermal expansion of the glass plates, i.e. the front and rear plates of the assembly. The thickness of the coating is controlled so as to be approximately equal to the height of the pixels. A thickness of between 0.1 mm to 0.3 mm is typical for the coating prior to firing.

The foregoing and other features of the invention are hereinafter more fully described and particularly pointed out in the claims, and the following description setting forth in detail certain illustrative embodiments of the invention, these being indicative, however, of but a few of the various ways in which the principles of the present invention may be employed.

DESCRIPTION OF THE PREFERRED EMBODIMENT

Figure 1:
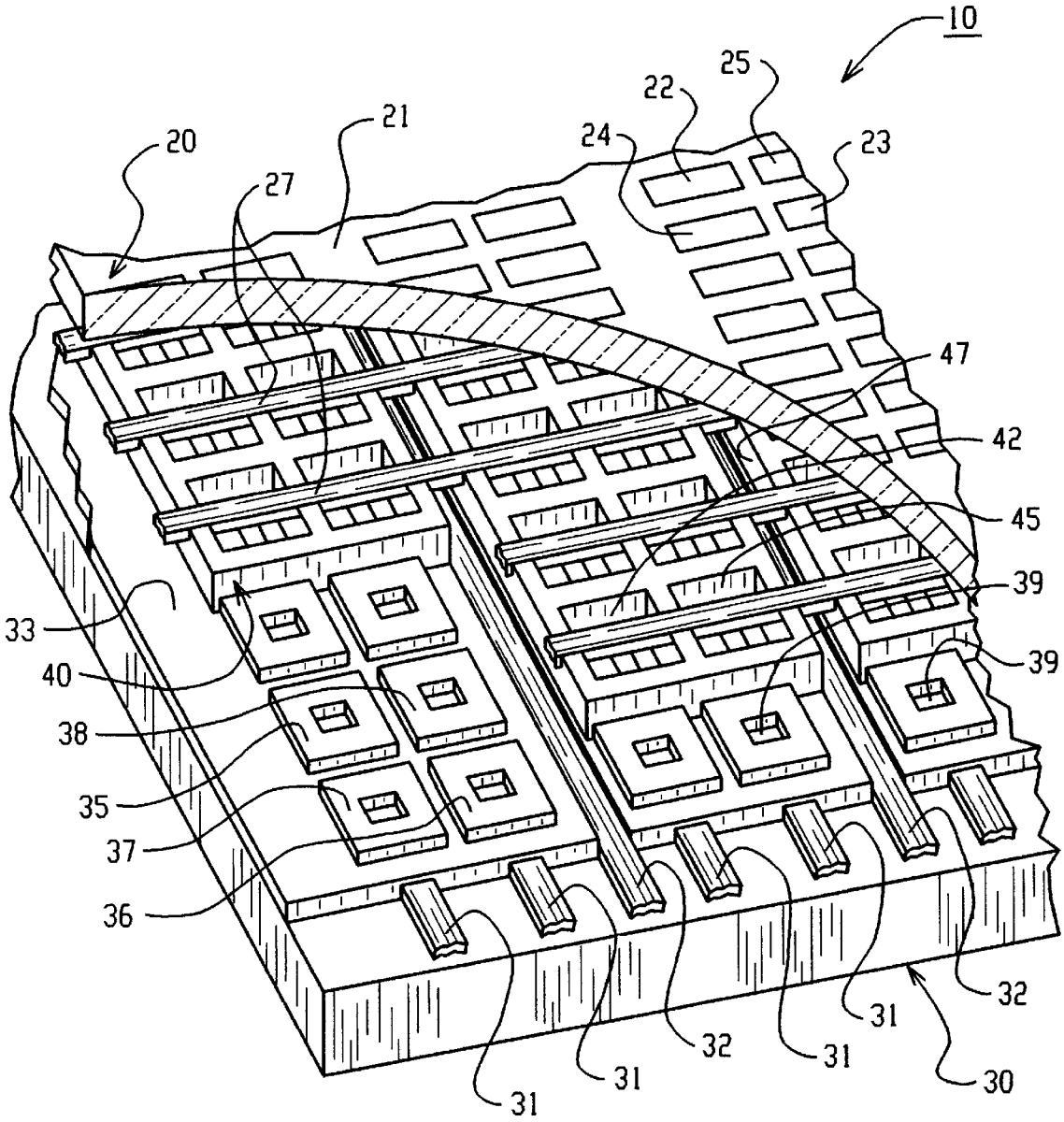
FIG. 1 is a fragmentary perspective view of a plasma display panel with parts broken away for the purpose of illustration, showing the type of panel to which the method of the invention relates.
Figure 2:
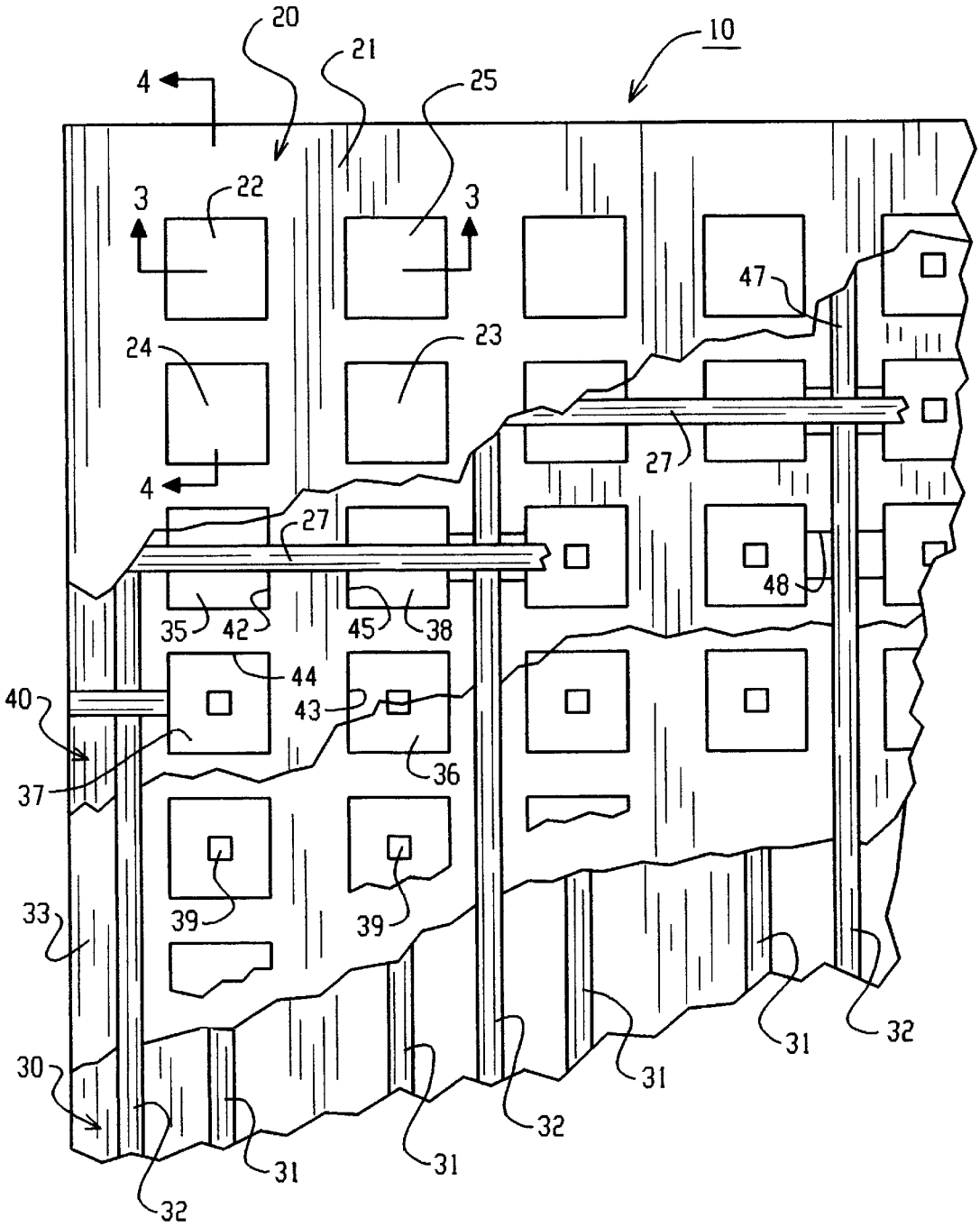
FIG. 2 is a fragmentary plan view, with parts broken away for the purpose of illustration of the plasma display panel of FIG. 1.
Figure 3:
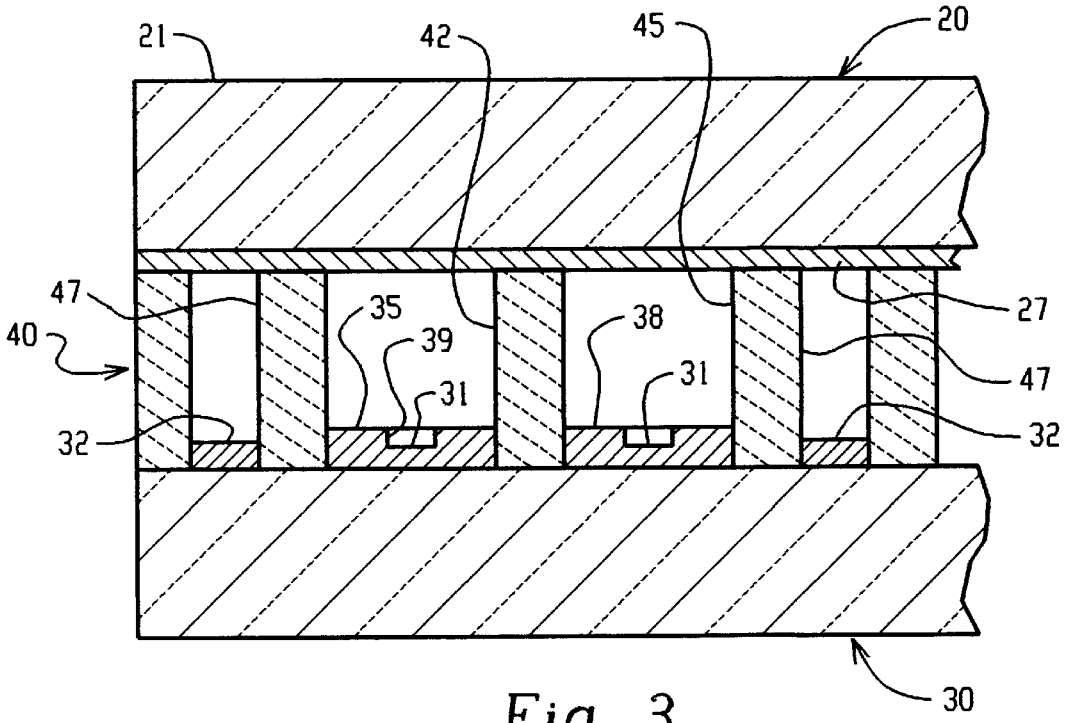
FIG. 3 is a fragmentary sectional view taken on the line 3—3 of FIG. 2.
Figure 4:
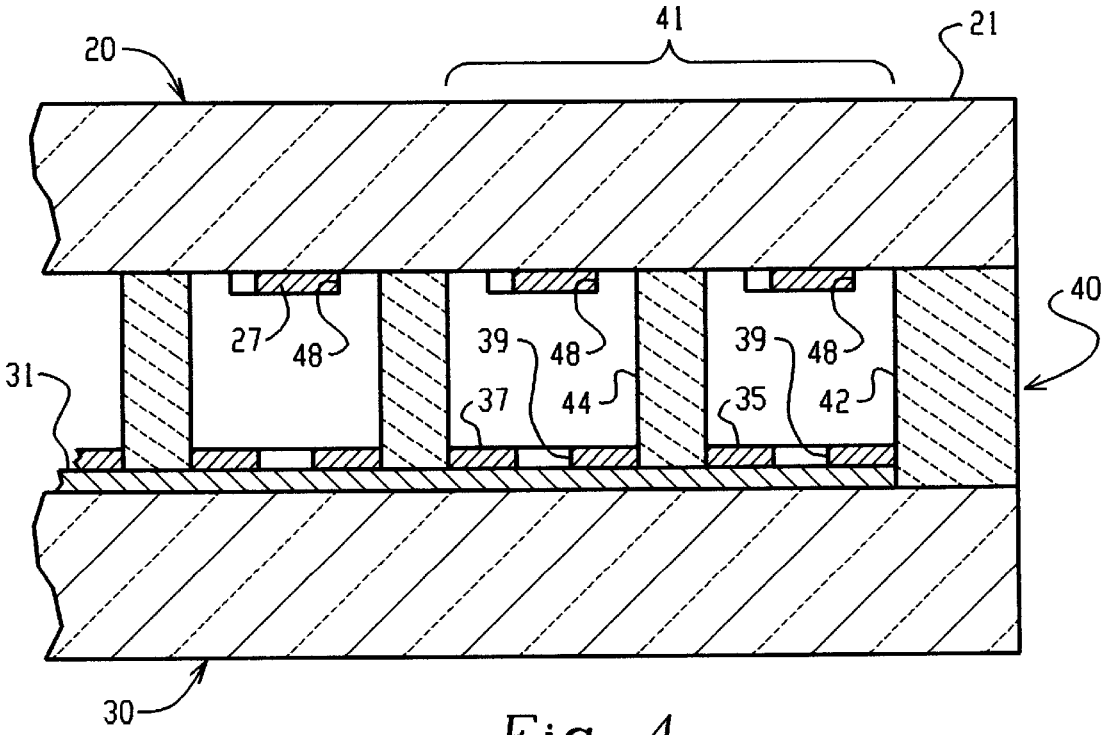
FIG. 4 is a fragmentary sectional view taken on the line 4—4 of FIG. 2.

The method of the invention (as to both forms disclosed above) will be described with reference to a typical plasma display panel that exemplifies the types of panel constructions known in the art. Referring to FIGS. 1–4, the plasma display panel 10 includes a pair of parallel glass plates including a front glass plate 20 and a rear glass plate 30 separated from one another by a barrier rib structure 40 constructed in accordance with the method of the invention.

The front glass plate 20 is formed of clear glass having a thickness of about 2 mm and having a film of black opaque material formed on its outer surface to produce a black matrix 21. The resulting matrix defines a pattern of rectangular areas corresponding to the size and number of pixel subcells in the particular plasma display panel.

A typical display panel size would be, for example, a 55" diagonal rectangle with 512 pixels in each vertical row and 768 pixels in each horizontal row. This would mean 1,024 color subcells in each vertical row and 1,536 color subcells in each horizontal row. Each square group of 4 subcells for a particular picture element is provided with a blue color filter 22 for the blue color subcell, a red color filter 23 for the red color subcell and two green color filters 24 and 25 for the two green color subcells. The filters are in the form of film segments that are affixed to the outer surface of the front glass plate 20 in the areas defined by the black matrix 21.

Also, the front glass plate 20 has a plurality of parallel conductor strips or cathodes 27 formed on the interior surface thereof by a screen printing or thick film technique, for example. The cathodes correspond to the vertical rows of pixels, there being two cathode strips for each pixel.

The rear glass plate 30 has a plurality of parallel conductive strips or display anodes 31 formed thereon such as by a screen printing process or thick film technique, as well as a plurality of auxiliary anodes 32 that are used to provide a priming function for the gas plasma in each subcell in a manner to be described below. One auxiliary anode strip is placed between every two pair of display anodes. It will be noted that the anode strips 31 and 32 extend perpendicular to the cathode strips 27 formed on the interior surface of the front plate 20.

Also, the rear plate 30 has a number of white backing sections 33 formed of dielectric material and applied in the form of thin layers to the interior surface of the rear plate 30 and over the display anodes 31. The sections 33, however, do not extend over the auxiliary anodes 32.

Mounted on the white backing sections 33 are a plurality of color phosphors 35, 36, 37 and 38. There are 4 phosphors for each pixel to include a blue phosphor 35 for each blue color subcell, a red phosphor 36 for each red color subcell and two green phosphors 37 and 38, one for each of the two green color subcells. A central opening 39 is provided in each phosphor to expose the gas plasma in the respective subcell to a conductive surface portion of a respective display anode 31.

The barrier rib structure 40 is a matrix of walls in a pattern that defines the individual pixels 41 and more particularly the 4 color subcells 42, 43, 44 and 45 of each pixel. Also, the barrier rib structure defines a plurality of parallel auxiliary plasma channels 47 located in correspondence with the auxiliary anodes 32 to provide a priming effect for the gas plasma in each color subcell. Each color subcell has one or more priming slots 48 that communicate between the interior of the subcell and the auxiliary plasma channel 47 so as to enable the priming voltage that excites the plasma in the auxiliary channel to "pre-excite" the respective color subcell.

THE PROCESS

The present invention is concerned with the construction of the barrier rib structure 40 that is interposed between the front glass plate 20 and the rear glass plate 30. It will be apparent that the structure must be formed of dielectric material and that it should be white in color in order to provide an optimum visual effect for the pixels that the barrier rib structure defines.

With this in mind, the various processes of the present invention (illustrated in FIGS. 5 and 6) have been developed. Since two forms of the process have been summarized above, they will be described separately below beginning with the particular form of the process that was described first. In accordance with this form of the process, a dielectric composition preferably containing one or more glasses and optionally one or more fillers in the form of fine particles, is prepared with a binder by mixing the components together with a suitable solvent. This resulting mixture may be a screen printable dielectric ink which is coated onto a glass plate using a doctor blade or other coating technique known in the art such as dipping-and-blotting or spraying.

The dielectric composition should have a relatively low sintering temperature (i.e. 450°–600° C.), a low dielectric constant, a high thermal conductivity, and a low coefficient of thermal expansion. It is particularly important that the coefficient of thermal expansion of the resulting sintered product be about the same as the coefficient of thermal expansion of the glass plates 20 and 30.

A dielectric material suitable for use with the present invention comprises, prior to firing, one or more glasses. An example of a preferred glass is a lead borosilicate glass.

A suitable glass composition is as follows (in weight percent):

| Component | Preferred | More Preferred |
|---|---|---|
| PbO | 40–75 | 45–70 |
| $B_2O_3$ | 3–25 | 5–15 |
| $SiO_2$ | 15–45 | 20–40 |
| $Al_2O_3$ | 0–12 | 5–8 |

The glass may also include up to 10% by weight of each of BaO, $ZrO_2$, $TiO_2$, $P_2O_5$ and other elements commonly employed in the production of glasses used in dielectric materials. Other elements or components that do not detrimentally affect the basic properties of the dielectric material may also be included in the glass.

The "solids portion" of the mixture utilized to produce the slurry of the present invention comprises the glass, refractory oxides, fillers, expansion modifiers and other like materials exclusive of any volatile or organic materials such as binders or vehicles.

The slurry comprises the precursors of the dielectric material (i.e., the solids portion) dispersed in an organic or polymeric material which includes binders, plasticizers, dispersants and other processing aids. Suitable binders include, for example, poly(vinyl butyral) resin or acrylic resin (methyl methacrylate, ethyl methacrylate, butyl methacrylate or their copolymers). The slurry (subsequent to drying of any solvents) generally comprises from about 5% to about 30% by weight polymeric material and from about 70% to about 95% solids portion. Subsequent to casting and prior to drying, the mixture of solids portion and flowable polymeric material comprises from about 5% to about 60% by weight flowable polymeric material and from about 50% to about 95% solids portion.

The flowable polymeric material is generally an organic binder and/or vehicle and is provided in an amount sufficient to disperse the solids in the flowable polymeric material and to at least temporarily bond the composition together prior to firing. The flowable polymeric material is usually an organic resin dissolved in a suitable solvent or mixture of solvents. Any essentially inert binder can be used in the practice of the present invention, including various organic liquids, with or without thickening and/or stabilizing agents and/or other common additives. Examples of the organic liquids which can be used are the aliphatic alcohols, esters of such alcohols, for example ethylalcohol, n-butyl acetate, terpenes such as pine oil, terpineol and the like, hydrocarbons such as toluene, isobutyl ketone, omnobutyl ether of ethylene glycol monoacetate, and carbinol.

The glass composition can be prepared in a conventional manner. For example, a mixture of the appropriate ingredients can be placed in a platinum crucible and melted (e.g., 850° C.–1100° C.), the resulting glass composition is then poured onto cold steel rolls to form thin flakes or frit which is suitable for milling. These flakes are then milled in a solvent to a suitable particle size distribution (e.g., about 0.5 to about 20 microns and preferably the median particle size is from about 3 to about 5 microns) The solvents preferably have a boiling point below about 15° C. and the heating step used to remove the solvent is conducted at a sufficient temperature to vaporize the solvent. Examples of such solvents include water, acetone, xylene, methanol, ethanol, isopropanol, methyl ethyl ketone, 1,1,1-trichloroethane, tetrachloroethylene, amyl acetate, 2,2,4-triethyl pentanediol-1,3-monoisobutyrate, toluene, methylene chloride and fluorocarbons.

The slip that is utilized to produce the slurry is produced by providing a mixture of the solids portion and the flowable polymeric material. The mixture is then processed through a ball mill or other suitable mixing and grinding equipment (e.g., a media mill or attritor mill).

In order to adjust or revise the TCE (thermal coefficient of expansion) of the dielectric material, one may include expansion modifier additives such as $CaZrO_3$, $Mg_2SiO_4$, $CaTiO_3$, $BaZrO_3$, $SrZrO_3$, spodumen, cordierite, fosterite, calcium silicate and mullite. Mixtures of such expansion modifiers may also be utilized.

The dielectric material can also be made using a refractory oxide in order to control shrinkage. Typical refractory oxide compositions include BeO, $Al_2O_3$, $TiO_2$, $SiO_2$ and $ZrO_2$. Mixtures of such refractory oxide compositions may also be utilized.

In addition to adding an expansion modifier or a refractory oxide, it will be appreciated that other materials, such as, for example, one or more additional glasses may be included in the solids portion used to form the dielectric material.

In order to further illustrate the slurry which may be used in the present invention, the following Example is provided. Unless otherwise indicated, in the following Example as well as throughout the entire specification and in the appended claims, all parts and percentages are by weight, and all temperatures are in degree centigrade.

EXAMPLE 1

A mixture having the following slip composition is provided:

| Weight In Grams | |
|---|---|
| Component | A |
| Glass A | 51.2 |
| A-16[1] | 7.3 |
| Dye[2] | 1.5 |
| Isobutyl Ketone | 19.6 |
| Ethanol | 12.8 |
| Santicizer 160 Plasticizer | 2.4 |
| Triton X-100 Dispersant | .4 |
| Poly(vinyl butyral) Resin | 4.8 |

[1]A-16 Superground $Al_2O_3$ available from Alcoa.
[2]K-393 Dye available from Ferro Corporation.

The glass A comprises by weight 65% PbO, 12% $B_2O_3$, and 23% $SiO_2$.

The mixture is lightly milled on a ball mill. The mixture 60 is then coated on the glass sheet 30 using conventional casting techniques and the solvent contained in the mixture is then dried at 70° C. The milled mixture has an average particle size of 3 microns.

After the resulting coating or layer is dried, a photoresist coating 62 is applied over it such as by screen printing, spin coating or as a predrawn film. This second coating or layer is also dried.

The photoresist may be selected from many suitable products readily available in the trade, such as a negative photoresist product identified by the trade designation ORDYL BF-205 sold by Tokyo Ohka Kogyo Co. Ltd., of Japan.

Figure 5:
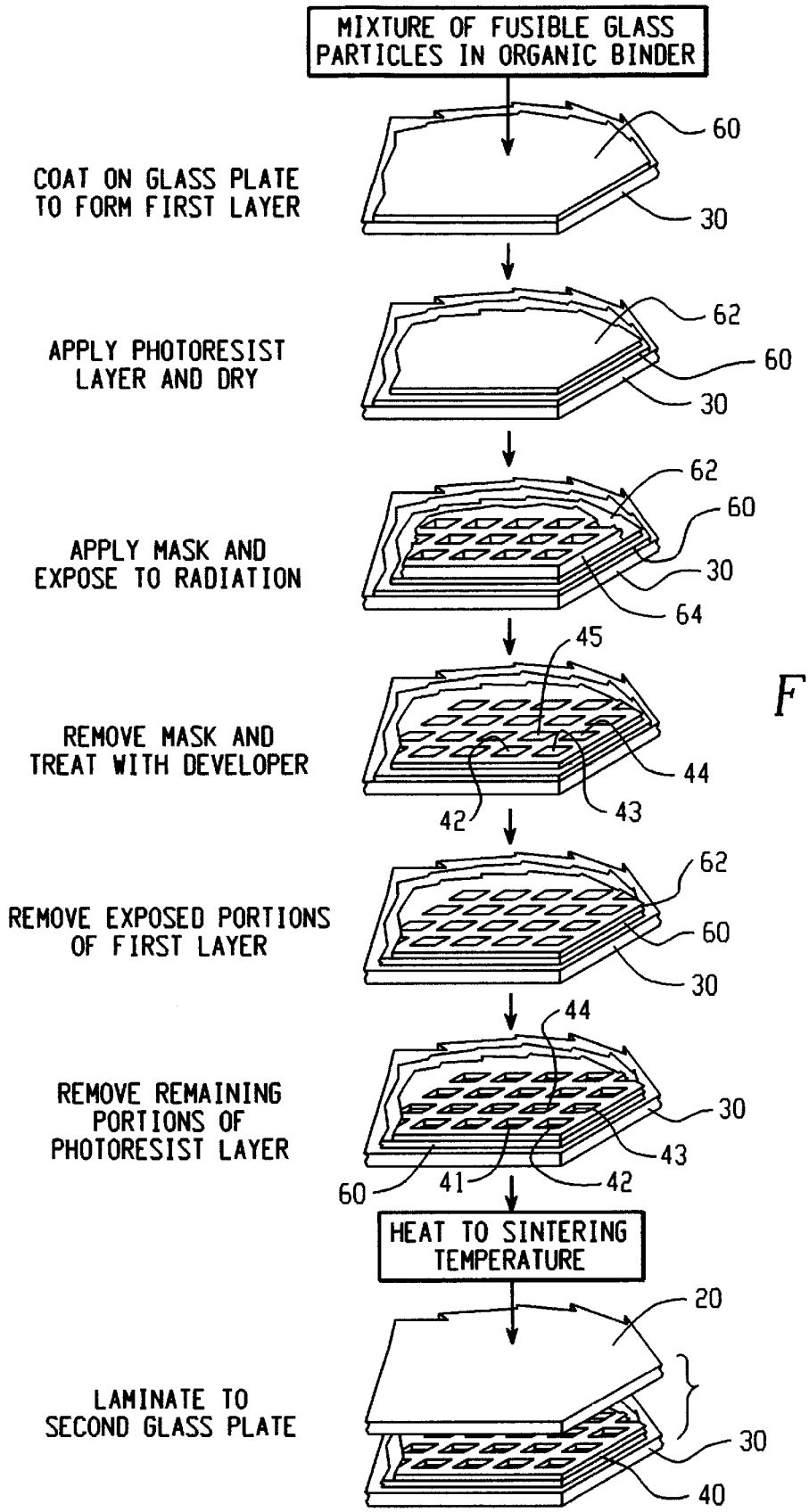
FIG. 5 is a schematic diagram illustrating the various steps comprising one form of the method of the invention.
Figure 6:
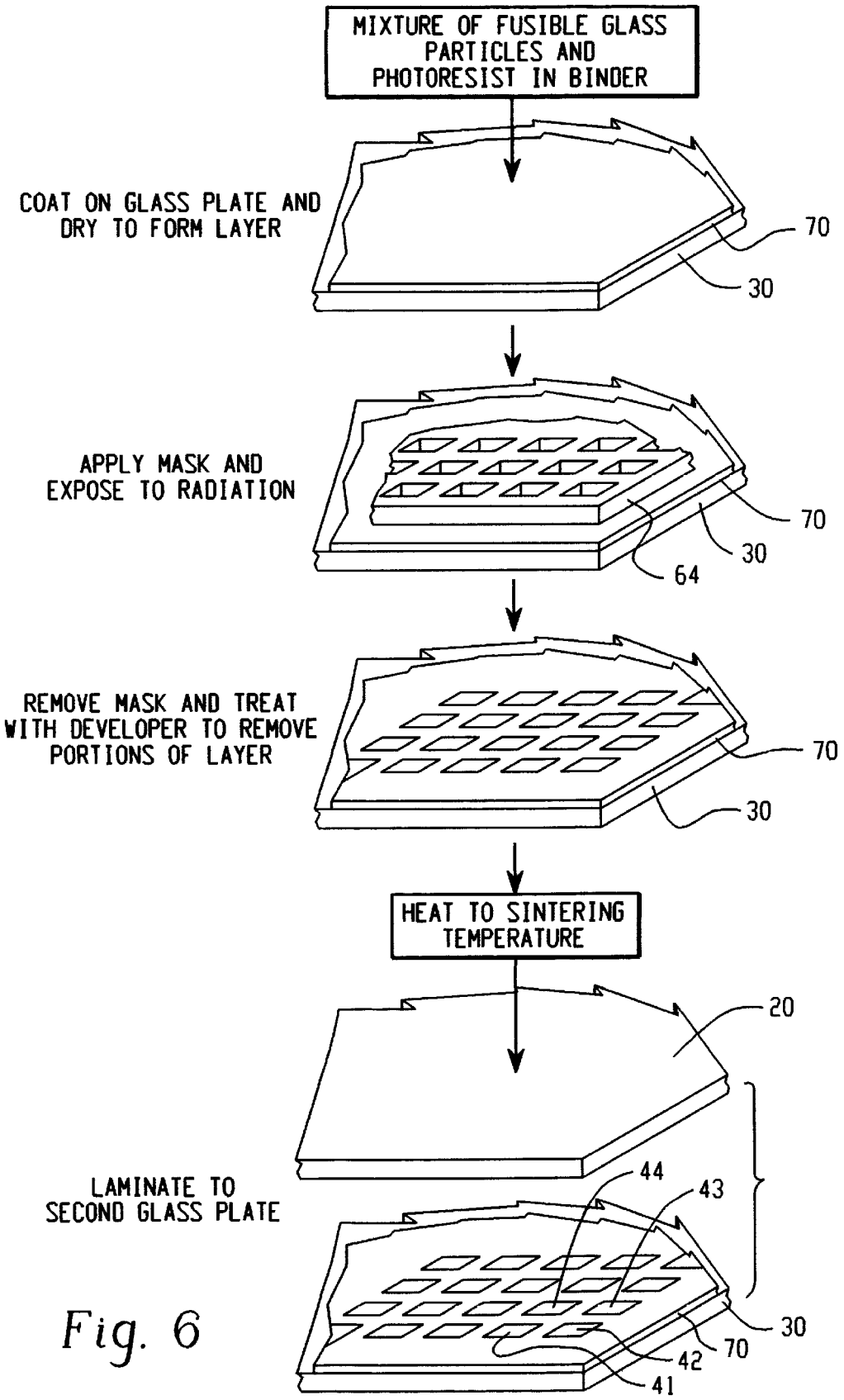
FIG. 6 is a schematic diagram illustrating the various steps comprising another form of the method of the invention.

Then a rigid image stencil or mask 60 corresponding to the desired barrier rib pattern is applied over the photoresist layer, the mask having a pattern of openings corresponding to the desired pattern of the pixels and subcells 42, 43, 44 and 45 as schematically illustrated in FIG. 5. In other words, there is one opening formed through the mask for each subcell. Also, slots may be formed to correspond to the desired pattern of the auxiliary plasma priming channels.

The resulting assembly is exposed to a light source to activate the unmasked portions of the photoresist layer. The mask is then removed and the assembly is treated with a developer to remove the activated portion of the photoresist layer in a pattern corresponding to the picture subcells.

The resulting product is then subject to physical treatment to remove portions of the first coated layer not covered by the photoresist layer. This may be done for example, by sand blasting or by laser treatment. The remaining portions of the photoresist layer are then removed by mechanical or chemical stripping, or burnout, for example, to leave a barrier rib structure on the substrate.

The resulting assembly is heated to a sintering temperature of about 450° C. to about 600° C. to fuse the perforated coating (and to burn off the binder) and form the barrier rib structure, and also to fuse the resulting barrier rib structure to the underlying glass plate.

As to the second form of the process of the invention as outlined above, the initial step is similar to that of the first, except that a photoresist is mixed directly in with the dielectric composition that is applied to the glass substrate. The resulting liquid photoresist/dielectric composition is for example, a screen-printable ink that can be photoimaged with ultra violet radiation or other light source. The thickness of the resulting layer must be carefully controlled due to the solid particles in the ink that could adversely affect the photoimaging if the layer is too thick.

After the printed dielectric layer is dried, a stencil or mask 64 is placed over it and the resulting assembly is exposed to a light source. Then the mask is removed and the assembly is treated with a developer to remove the unmasked portions of the layer and to form the color subcells.

Finally, the resulting product is heated to sintering temperature to fuse the dielectric composition, burn off the organic binder and fuse the resulting barrier rib structure to the substrate.

An example of a photoresist that may be utilized to produce the liquid photoresist/dielectric composition is a negative liquid photoresist which is available from the Microelectronic Materials Division of Olin Chemical of Rhode Island. For example, from about 30% to about 80% by volume of liquid photoresist could be mixed with the slip composition of Example I to provide a suitable ink.

Since there are many variations as to the construction of plasma display devices, it will be assumed that the process described above will be adapted to the panel construction utilized by a particular manufacturer. For example, the location of the phosphors may vary from one design to another and the location of priming slots 46 between the auxiliary plasma channels and the individual color subcells may take many forms. The arrangement of the electrodes may be varied in many ways by individual manufacturers. Also, it will be noted that the invention has application to other types of products where a barrier rib structure or the like is desired and wherein it is to be constructed on a glass plate formed of fusible dielectric material.

It will be appreciated to the particular composition of glasses, fillers and binders utilized to produce the slurry, many alternatives may be selected to satisfy different applications of the invention, such as, for example, the firing time and temperature of the structure and the coefficient of expansion of the glass plates.

Finally, it will be appreciated that instead of employing negative photoresist materials, one could employ positive photoresist materials and utilize a mask that is opposite or negative in construction as compared to a mask intended for use with a negative photoresist. When a positive photoresist is utilized, the unexposed or unradiated portions of the photoresist containing layer will be removed by the developer instead of the exposed or radiated portions when a negative photoresist is utilized.

It will be understood that the method of the invention has been shown and described with respect to specific embodiments thereof, and other variations and modifications of the specific method herein shown and described will be apparent to those skilled in the art all within the intended spirit and scope of the invention. Accordingly, the patent is not to be limited in scope and effect to the specific embodiments herein shown and described, nor in any other way that is inconsistent with the extent to which the progress in the art has been advanced by the invention.

We claim:

1. A method of making a laminated glass structure defining a plurality of cells comprising the steps of:

A. preparing a liquid composition comprising fusible dielectric particles in a binder;

B. applying the liquid composition onto a glass substrate to form a first layer;

C. drying said first layer;

D. applying a liquid photoresist composition over the dried first layer to form a second layer;

E. drying said second layer;

F. placing a mask over the second layer to provide a pattern corresponding to the pattern of said cells;

G. exposing said masked second layer to radiation from a light source;

H. removing the mask;

I. treating the second layer with a developer to remove portions thereof to provide a pattern of exposed surface portions of said first layer;

J. removing the portions of said first layer not covered by the remaining portions of said second layer by laser cutting to form the cells;

K. removing the remaining portions of said second layer; and

L. heating the resulting product to a sintering temperature to fuse said dielectric composition and to fuse the resulting structure to said glass substrate.

2. A method as set forth in claim 1 wherein said laminated glass structure comprises a plasma display panel that includes a glass front plate, a plurality of subcells, and an electrical control circuit for activating said subcells.

3. A method as set forth in claim 1 wherein said heating step L. is conducted at a temperature of from about 450° C. to about 600° C.

4. Amethod of making abarrierrib structure for a plasma display panel that includes a glass front plate, a glass rear plate and a plurality of plasma-containing picture elements defined by said front and rear plates and said barrier rib structure, each picture element including a plurality of subcells said method comprising the steps of:

A. preparing a liquid composition comprising fusible dielectric particles in a binder;

B. applying the liquid composition onto a dielectric substrate to form a first layer;

C. drying said first layer;

D. applying a liquid photoresist composition over the dried first layer to form a second layer;

E. drying said second layer;

F. placing a mask over the second layer to provide a pattern of openings corresponding to the pattern of picture subcells for said plasma display panel;

G. exposing said masked second layer to radiation;

H. removing the mask;

I. treating the second layer with a developer to remove portions thereof to provide a pattern of exposed surface portions of said first layer corresponding to the pattern of said picture subcells;

J. removing the portions of said first layer not covered by the remaining portions of said second layer by laser cutting to form the picture subcells;

K. removing the remaining portions of said second layer; and

L. heating the resulting product to a sintering temperature to fuse said dielectric composition and to form said barrier rib structure and to fuse said barrier rib structure.

5. A method as defined in claim 4 wherein said liquid photoresist comprises negative photoresist and during said step I the exposed portions of the second layer are removed by the developer.

6. A method as defined in claim 4 wherein said liquid photoresist comprises a positive photoresist and during said step I the unexposed portions of the second layer are removed by the developer.

7. A method as set forth in claim 4 wherein said heating step is conducted at a temperature of from about 450° C. to about 600° C.

* * * * *